US009496671B2

(12) United States Patent
Dierks et al.

(10) Patent No.: US 9,496,671 B2
(45) Date of Patent: Nov. 15, 2016

(54) CRIMPING TOOL FOR WIRE END FERRULES

(71) Applicant: Weidmueller Interface GmbH & Co. KG, Detmold (DE)

(72) Inventors: Christoph Dierks, Detmold (DE); Guenther Hanning, Detmold (DE); (Continued)

(73) Assignee: Weidmueller Interface GmbH & Co. KG, Detmold (DE)

( * ) Notice: Subject to any disclaimer, the term of this patent is extended or adjusted under 35 U.S.C. 154(b) by 195 days.

(21) Appl. No.: 14/407,059

(22) PCT Filed: Jun. 12, 2013

(86) PCT No.: PCT/EP2013/062079
§ 371 (c)(1),
(2) Date: Dec. 10, 2014

(87) PCT Pub. No.: WO2014/009083
PCT Pub. Date: Jan. 16, 2014

(65) Prior Publication Data

US 2015/0180190 A1 Jun. 25, 2015

(30) Foreign Application Priority Data

Jul. 11, 2012 (DE) ..... 20 2012 102 561 U

(51) Int. Cl.
*B25B 7/06* (2006.01)
*H01R 43/042* (2006.01)
*B25B 7/12* (2006.01)

(52) U.S. Cl.
CPC ..... *H01R 43/0428* (2013.01); *B25B 7/06* (2013.01); *B25B 7/123* (2013.01); *H01R 43/0424* (2013.01); *Y10T 29/53226* (2015.01)

(58) Field of Classification Search
CPC ..... B25B 7/06; B25B 7/123; H01R 43/0424; H01R 43/0428; Y10T 29/53226
See application file for complete search history.

(56) References Cited

U.S. PATENT DOCUMENTS 2,933,000 A * 4/1960 Wood ..... H01R 43/0424 72/402
3,059,511 A 10/1962 Morris
(Continued)

FOREIGN PATENT DOCUMENTS

DE 195 07 347 C1 9/1996
DE 10 2005 003 617 B3 6/2006
(Continued)

*Primary Examiner* — Carl Arbes
(74) *Attorney, Agent, or Firm* — Lawrence E. Laubscher, Sr.; Lawrence E. Laubscsher, Jr.; Robert D. Spendlove

(57) ABSTRACT

A scissors-type crimping tool for crimping a female contact onto an electrical conductor, comprising a planar base member having body and first lever portions; an annular crimping die member connected for rotation between die-open and die-crimping positions relative to the base member body portion; a toggle link arrangement connecting a second lever for pivotal movement relative to the base member body portion; and a cascade spring arrangement operable by the toggle arrangement from a non-stressed condition to a stressed caged condition during initial movement of the second lever in the closed direction, and to a stressed condition during further movement of the second lever, thereby to afford processing of different cross-sections of ferrules and conductors in the crimping die, and to apply the force of the stressed cascade spring arrangement to the crimping die member during the final stage of the crimping operation.

12 Claims, 9 Drawing Sheets

(72) Inventors: Detlev Hetland, Detmold (DE); David Keller, Lemgo (DE)

(56) References Cited

U.S. PATENT DOCUMENTS

| | | | | | |
|---|---|---|---|---|---|
| 3,094,702 | A * | 6/1963 | Haucke | H01R 43/042 | 29/243.57 |
| 3,199,334 | A * | 8/1965 | Holmes | H01R 43/0424 | 72/409.01 |
| 3,199,335 | A * | 8/1965 | Holmes | H01R 43/0424 | 72/409.01 |
| 3,354,692 | A * | 11/1967 | Morris | H01R 43/0424 | 72/402 |
| 3,738,150 | A * | 6/1973 | Holmes | H01R 43/045 | 29/282 |
| 7,874,193 | B2 | 1/2011 | Norin | | |
| 8,196,288 | B2 * | 6/2012 | Wagner | H01R 4/185 | 29/237 |

FOREIGN PATENT DOCUMENTS

| | | |
|---|---|---|
| EP | 1 820 608 A2 | 8/2007 |
| JP | S51-022 297 Y | 6/1976 |
| JP | S54-124192 U | 8/1979 |
| JP | S56-041 991 | 4/1981 |

* cited by examiner

CRIMPING TOOL FOR WIRE END FERRULES

REFERENCE TO RELATED APPLICATIONS

This application is a national stage application under 35 C.F.R. §371 of the PCT International Application No. PCT/EP2013/062079 filed Jun. 12, 2013, which claims priority of the German application No. DE 20 2012 102 561.2 filed Jul. 11, 2012.

BACKGROUND OF THE INVENTION

Field of the Invention

A scissors-type crimping tool is provided for crimping a female electrical contact onto an electrical conductor, including a toggle arrangement actuated by an operating lever to operate cascade spring means from a non-stressed condition to a stressed caged condition, thereby to afford processing of different cross-sections of ferrules and conductors in the crimping die, and to apply the force of the stressed cascade spring arrangement to the crimping die member during the final stage of the crimping operation.

Description of Related Art

Crimping tools are known from the prior art, as shown by the German patent No. DE 195 07 347 C1, which discloses the use of pressing tongs for crimping wire end ferrules in which force path compensation is provided by a spring lever integrated into and fastened in the handle part, brought into an active connection with a lever arm of the toggle joint drive and by a cross-sectional reduction in the form of a constriction located in the middle section of the fixed handle part.

However, the force path compensation device realized in this manner allows only a very limited diameter range of wire end ferrules that can be pressed in the pressing tongs.

Therefore, a crimping tool is desired for wire end ferrules that allows the crimping of wire end ferrules on conductors in the greatest possible diameter range so that the greatest possible spectrum of conductor cross sections can be provided with wire end ferrules with a single crimping tool.

The present invention therefore has the basic task of creating a crimping tool for wire end ferrules that avoids the above-cited disadvantages.

SUMMARY OF THE INVENTION

Accordingly, a primary object of the present invention is to provide a scissors-type crimping tool for crimping a female electrical contact onto an electrical conductor, including a toggle arrangement actuated by an operating lever to operate cascade spring means from a non-stressed condition to a stressed condition, thereby to define a force path compensation device for processing different cross-sections of ferrules and conductors in the crimping die, and for applying the force of the stressed cascade spring arrangement to the crimping die member during the final stage of the crimping operation.

According to a more specific object of the invention, the cascade spring means includes a first leaf spring defined by a slot contained in a frame body portion such that said leaf spring has a free end pivotally connected with a toggle thrust link, and a second leaf spring mounted on the operating lever, whereby said first and second leaf springs are stressed by said toggle thrust link during the initial movement of the operating lever from an open position toward an intermediate position. A stop arrangement limits the extent to which the first leaf spring may be stressed.

According to a further object, a crimping tool is provided in which a greater force and a greater force path are made available by the advantageous spring effect produced by the cooperation of the springs. This ensures that wire end ferrules and conductors can be crimped with the greatest possible diameter range with the crimping tool. Therefore, the path taken by the initially cited prior art is avoided, and the force path compensation device is realized in an entirely different manner.

The part of the cascade spring, that is part of the base sheet, is preferably realized by a slot contained in the base sheet, which slot runs substantially parallel to the outer contour of the base sheet. In order to reduce the mechanical stress on the end point of the notch, the end point of the notch is designed to be rounded. The contour of the notch advantageously runs around the articulation bolt and exits out of the base sheet on the upper side of the handle. Therefore, the spring obtains a geometry substantially in the form of a leaf spring shaped like an arch or circular segment. In order to realize a significant spring path, the notch is preferably designed to be appropriately long and wide. Therefore, the spring realized in this manner lies outside of the handle. Therefore, a parallel connection of both springs results by the arrangement of the notch in both of the side base sheets of the frame.

The crimping elements preferably have circular blind holes on their side surfaces by which the crimping stamps are rotatably supported on bearing pins on the base sheets. The non-through counter-bored bearing pins of the crimping elements advantageously result in a correspondingly greater carrying cross section of the crimping stamp so that the crimping elements have elevated mechanical load properties compared to comparable constructions with through bearing pins.

Furthermore, the sliding piece plate preferably has a peroration in the form of a recessed hexagonal round profile in which sliding pieces are rotatably mounted and transfer the drive force resulting from the toggle joint kinematics onto the crimping stamps. A radial longitudinal compensation for the crimping elements is made possible by a groove in the slide pieces which provide compensation by the pivotal movement of the crimping elements. The advantage of this solution lies in a flat contact, and therefore in a reduced local surface pressure between sliding piece and crimping stamps over the entire activation path.

For an optimized pressing and a reduction of fracture of the crimped wire end ferrules, the crimping elements advantageously have a corrugated contour on the active stamping surface. A sharp-edged construction such as, e.g., triangular or quadratic contours on the active stamping surface would leave, in comparison, a sharp-edged impression on the finished, crimped wire end ferrule that would increase the sensitivity to fracture of the crimped wire end ferrules. In order to prevent a clamping of wire end ferrules with a rather small cross section between the crimping stamps, the contour of the active stamping surface is advantageously constructed in such a manner that adjacent crimping stamps merge into one another in a contour-congruent manner.

The contour of the active stamping surface is furthermore designed in such a manner that, given the appropriate positioning of the wire end ferrule into the crimping die on the end of the wire end ferrule, an introductory slope is produced that facilitates the introduction of the wire end ferrule into a clamping system.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
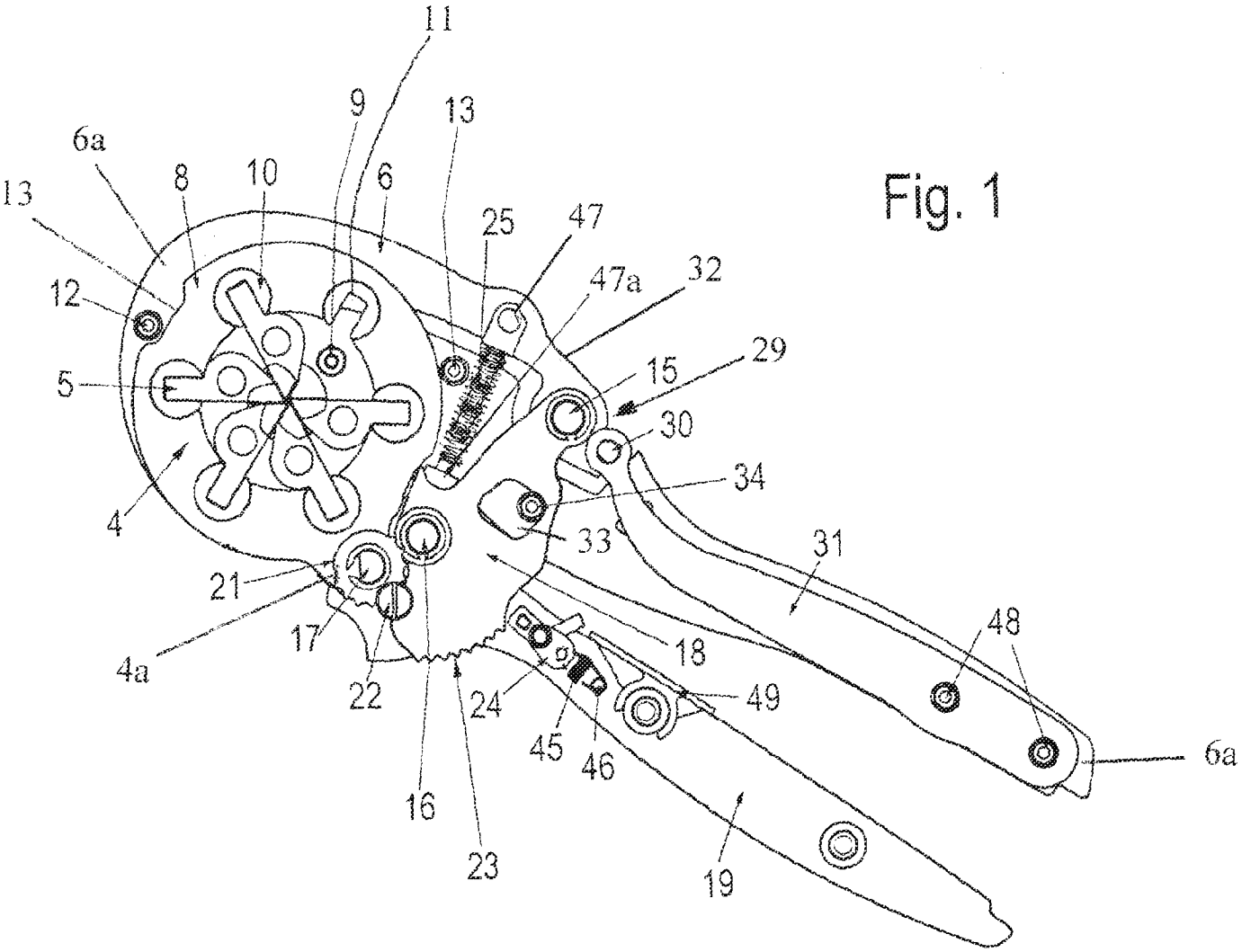
FIG. 1 is left elevation view of the crimping tool of the present invention, with certain parts removed, when in the closed crimping condition.
Figures 2, 3:
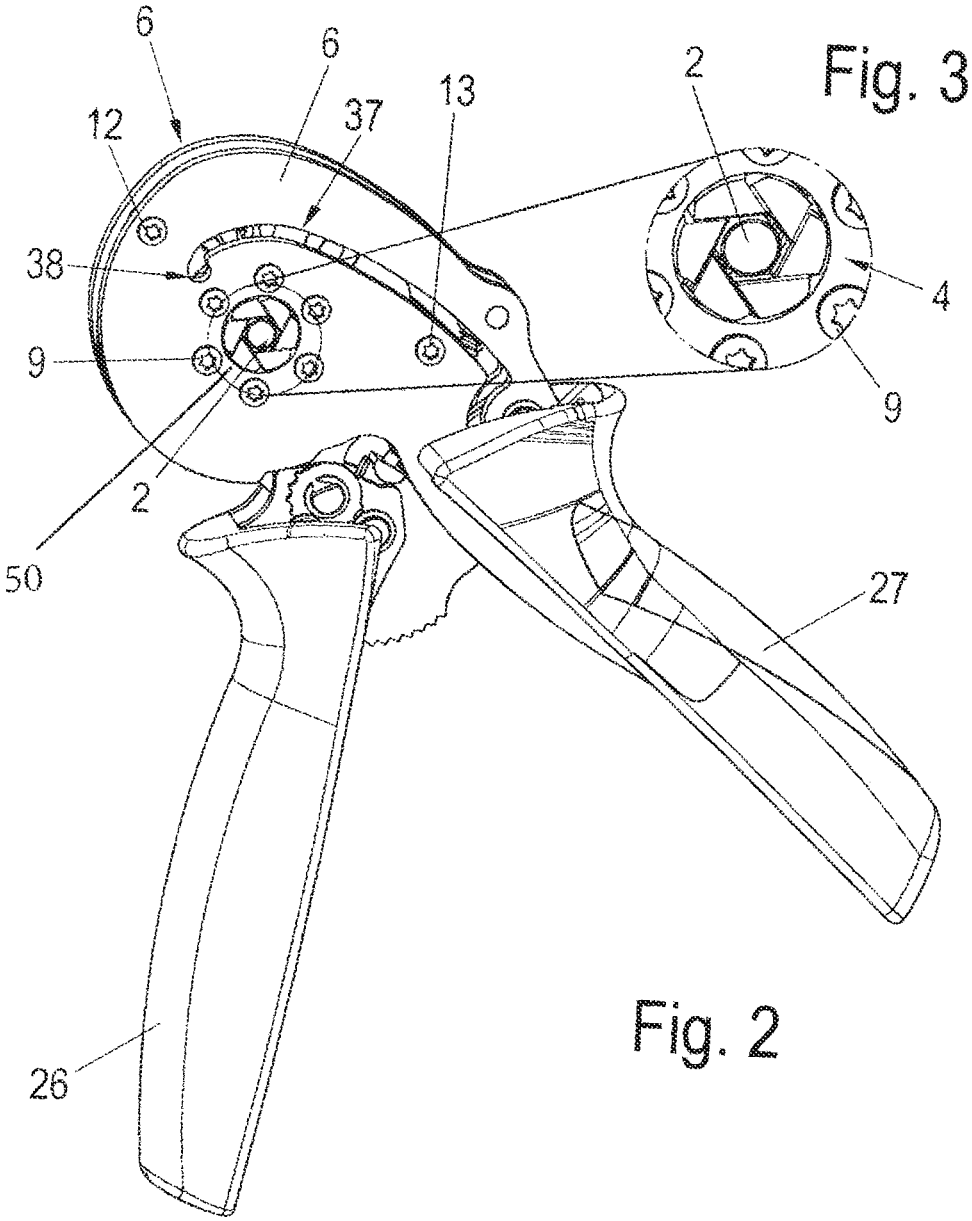
FIG. 2. Is a left perspective view of the apparatus of FIG. 1 when in the open condition.
FIG. 3 is a detailed view of the die means of FIG. 2.
Figure 8:
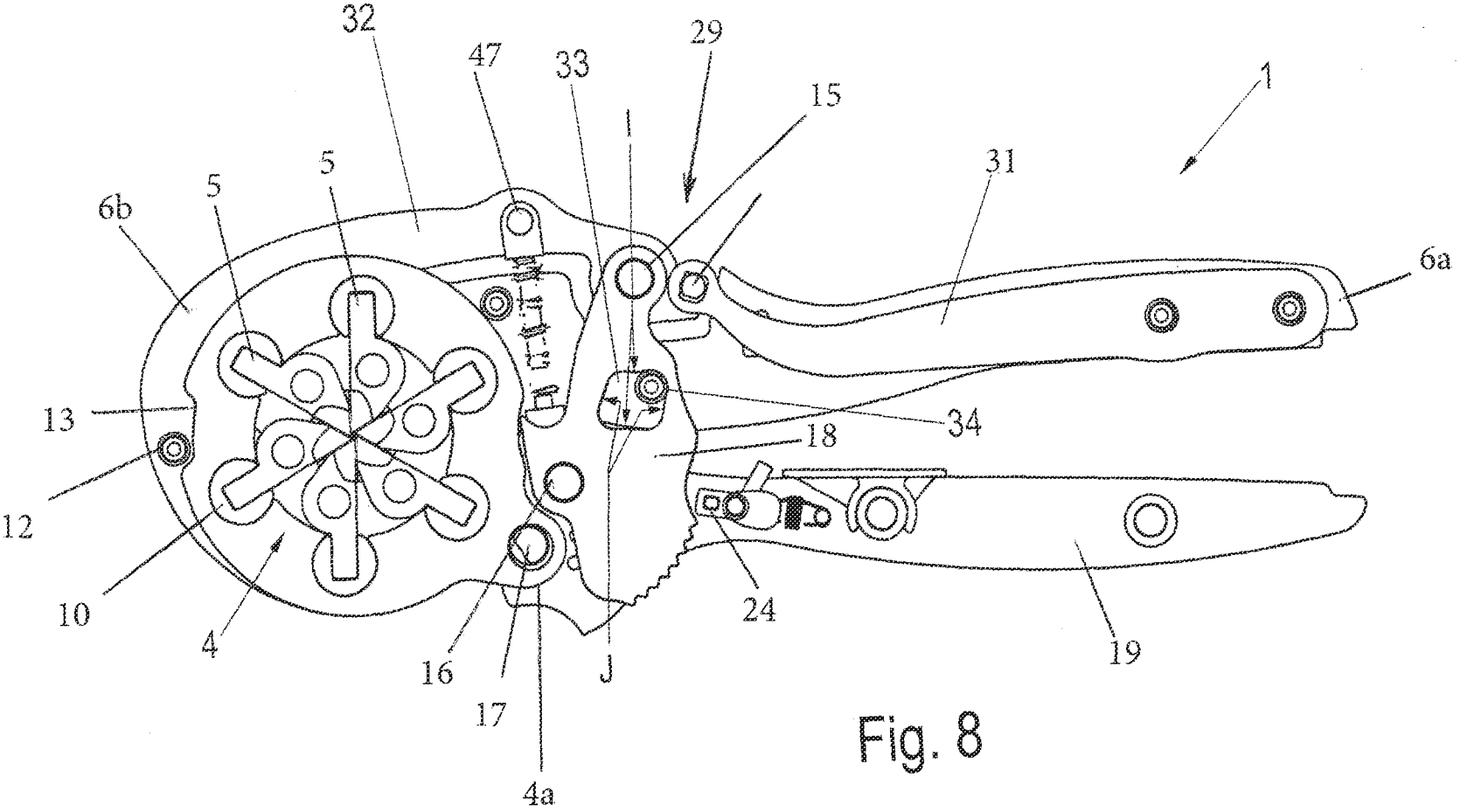
FIG. 8 is a side elevation view illustrating the operation of the spring stop means when the apparatus of FIG. 1 is in the closed crimping condition.

Referring first more particularly to FIGS. 1-3, the crimping tool 1 of the present invention is designed to crimp female contacts, cable terminals or the like on electrical conductors 3. The manually operated crimping tool 1 in the form of tongs comprises a crimping die 4 with automatic adjustment to the crimping ferrule cross section and the conductor cross section to be worked that is formed from several crimping stamps 5. The pressed wire end ferrule 2 can be constructed in particular in a hexagonal or quadratic shape. The crimping tool includes a pair of parallel spaced side plates 6 that are formed from a resilient metal material, such as spring steel. The side plates have parallel lever portions 6*a* that extend from base body portions 6*b* containing opposed access openings 50 (FIG. 2), thereby to define a first operating lever. The side plates are connected by bolt and spacer means 12 and 13. Rotatably mounted for angular displacement between the side plate body portions 6*b* is an annular die member 4 arranged collinearly relative to the opposed access openings 50. As shown in FIG. 8, the die member 4 includes a radially outwardly extending position-adjusting tab portion 4*a*.

Rotatably mounted in recesses contained in circumferentially spaced relation on the inner circumference of the die member are a plurality of cylindrical members 10 that contain radial slots 11 in which are mounted the end portions of a plurality of crimping elements 5, respectively. The other ends of the crimping elements are provided with crimping tips, and the intermediate portions of the crimping elements are pivotally connected with the side plates by pivot pins 9, respectively. The crimping elements 5 have circular blind holes 28 on the side surfaces by which the crimping elements 5 are rotatably supported on bearing pins 9 on the base sheets 6. The non-through counter-bored bearing pins 9 of the crimping stamps 5 result in a correspondingly greater carrying cross section of the crimping stamp 5 so that the crimping stamps 5 have increased mechanical load properties in comparison to comparable constructions with through bearing pins 9. The pivot movement of the crimping stamps 5 produces a continuously diminishing opening 7 of the crimping die 4 in which the wire end ferrule 2 (not shown) is pressed. Thus, angular displacement of the die member 4 causes displacement of the die elements between the closed positions of FIG. 1 and the open positions of FIGS. 2 and 10. The extent of angular displacement of the die member 4 is limited by the cooperation between spacer pin 12 and the slot 13 provided in the outer circumferential surface of the die member.

Figure 4:
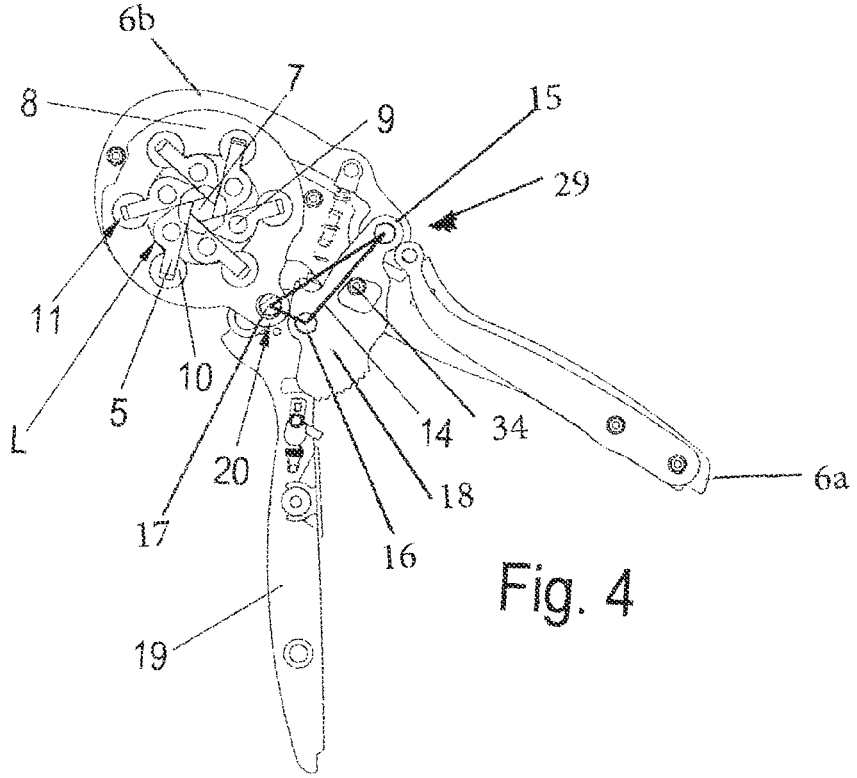
FIG. 4 is a left side elevation view of the apparatus of FIG. 1 when in the open condition, with certain parts removed.

A second operating lever 19 is pivotally connected at one end by pivot pin 16 with the base body portions 6*b* of the frame by the thrust plate 18 of a toggle linkage 14 (FIG. 4). The other end of the thrust plate is pivotally conned by pivot pin 15 with the base portions 6*b* of the side plates 6, thereby connecting the second lever 19 for generally pivotal displacement between closed (FIG. 1) and open (FIG. 2) positions relative to the frame. The thrust plate is also pivotally connected by pivot pin 17 with the tab portion 4*c*, whereby pivotal movement of the operating levers 6*a* and 19 effect angular displacement of the die member 4 to pivot the die elements from their open positions toward their crimping positions. The operating levers 19 and 6*a* are provided with handles 26 and 27 (FIG. 2) that are formed from a resilient cushioning insulating material, such as rubber, or a corresponding synthetic plastic material.

In order to adjust the initial angular position of the die member 4 relative to the side plate body portions 6*b*, the pivot pin 17 comprises an eccentric bolt that is rotatably adjustable by adjusting disk 21 and flat head screw 22. Thus, the position of the crimping die member 4 can be changed by rotating the eccentric bolt 17. As a result, the degree of opening of the opened crimping die 4 can be adapted to the diameter of the wire end ferrule 2 before the crimping so that a considerable part of the working stroke of the crimping die 4 does not have to be made solely as an unproductive empty stroke until the crimping die 4 makes contact with the wire end ferrule 2. The adjusting disk 21 and the flat head screw 22 fix the eccentric bolt 17 in the adjusted position. The eccentric bolt 17 serves here only for the basic adjustment and optionally for the compensation of manufacturing tolerances. The eccentric bolt 17 is usually not adjusted by the user of the crimping tool.

Figure 9:
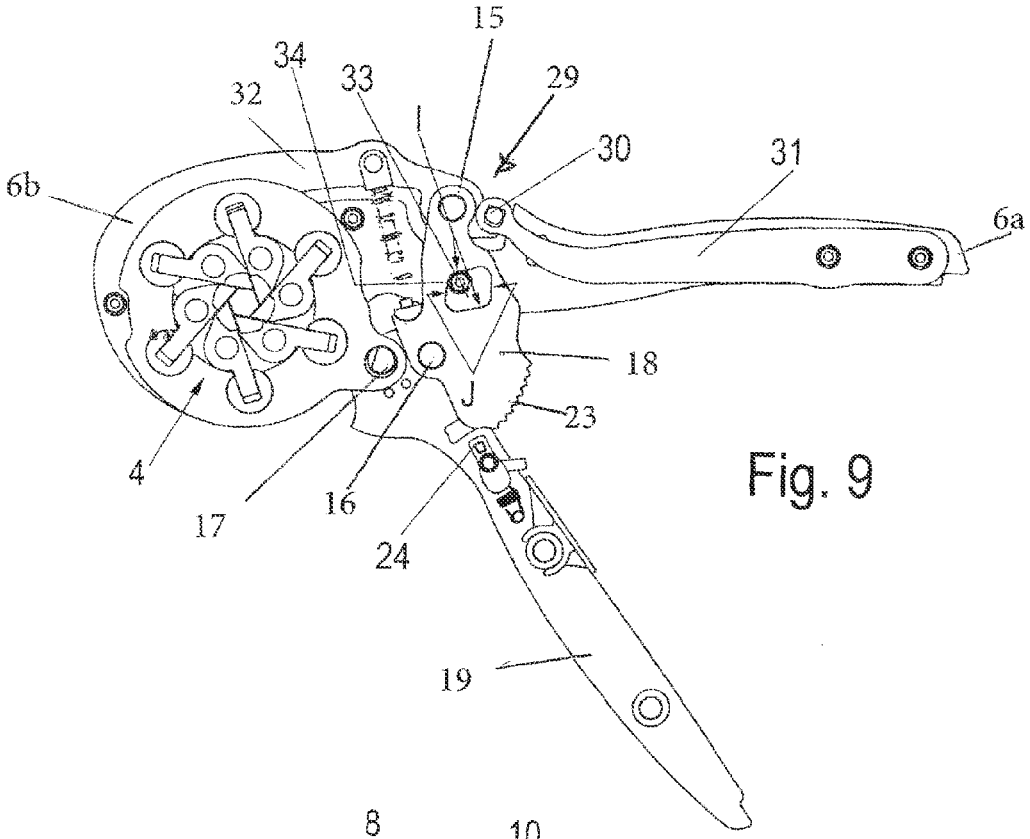
FIG. 9 is a corresponding view when the operating levers are in the open condition.

The levers 6*a* and 19 are normally biased toward the open condition of FIG. 2 by means of a compression biasing spring 25 pivotally connected at one end by pivot pin 47 with the body portions 6*b* of the side plates, and provided at its other end with an enlargement 47*a* that extends into a corresponding groove contained in the thrust plate 18. To prevent return during pivotal movement of the levers from the open position toward the closed position, ratchet and pawl means are provided including a ratchet 23 formed on the thrust link, and an associated pawl 24 provided on the lever 19. Biasing and release means 45, 46 and 49 are provided for biasing the pawl toward the ratchet when the levers are in the open position (FIG. 9), and for releasing the pawl from the ratchet when the levers are in the fully closed condition (FIGS. 1 and 8).

Figure 13:
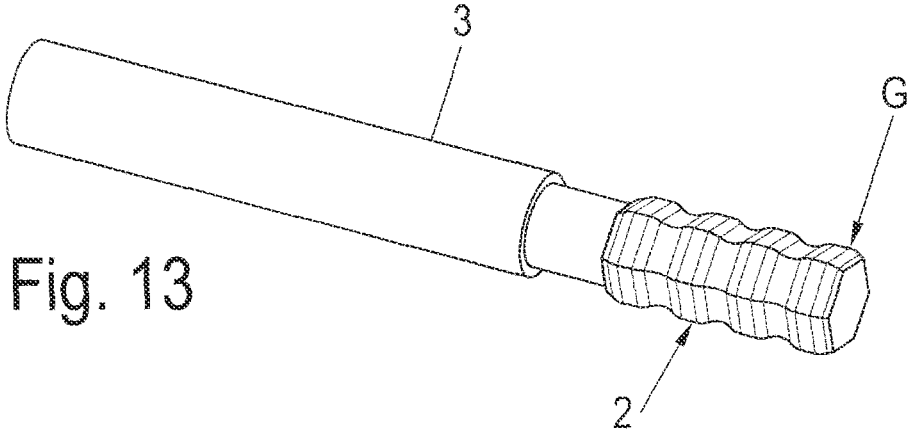
FIG. 13 is a perspective view of a female metal contact crimped on the bare wire end of an insulated conductor.

As shown in FIGS. 2 and 3, when the operating levers are in the open condition, the crimping elements are in an open condition for receiving a female conductive metal contact that is to be crimped upon the bare end of an insulated conductor 3, as shown in FIG. 13. The hand grips 26 and 27 do not have any local cross-sectional reduction or weakening, e.g. in the form of a constriction from which an elevated elasticity or an elevated spring action would result.

Figure 5:
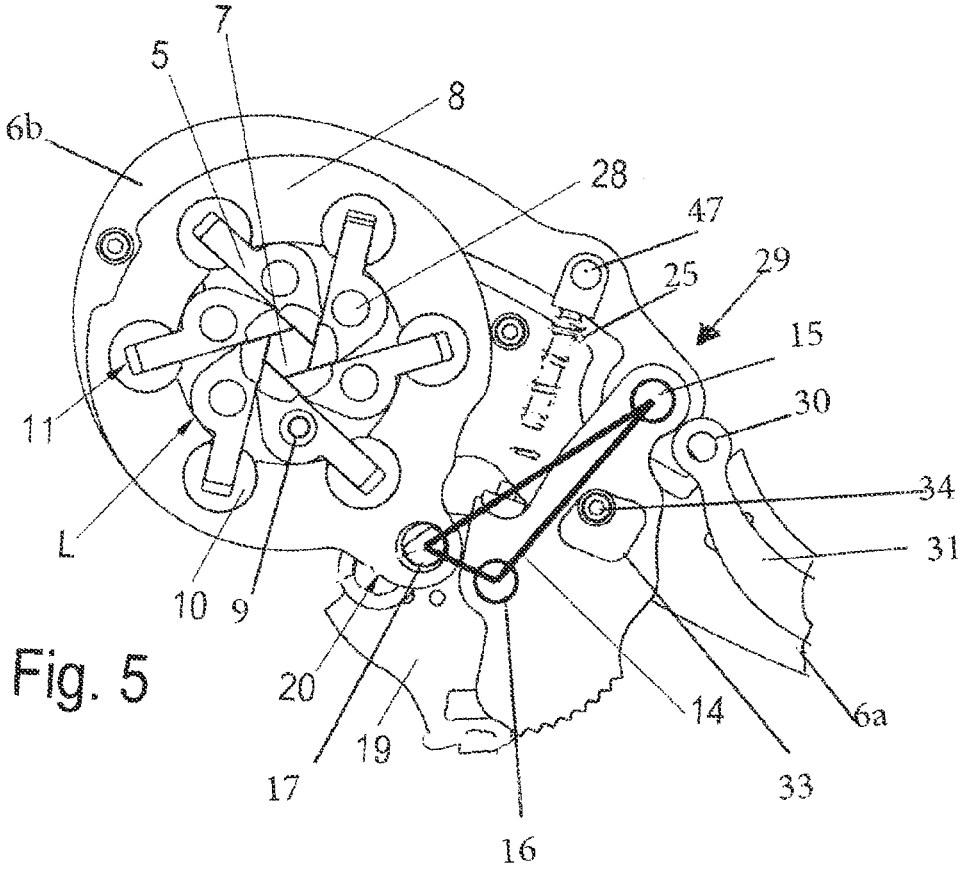
FIG. 5 is a detailed view of the die mechanism of FIG. 4.

Referring now to a characterizing feature of the present invention shown in FIGS. 4 and 5, a toggle linkage 14 is defined by the pivot pins 15, 16 and 17, such that when the operating levers are in the open position, the pivot pin 17 is on one side of the line defined by the pivot pins 15 and 16, and when the operating levers are in the closed condition of FIG. 8, the pivot pin 17 is toggled to a position generally in alignment with the pivot pins 15 and 16. Owing to the angular adjustment of the die member 4 by the cooperation between pivot pin 17 and tab portion 4*b*, the die elements 5 are pivoted toward their closed positions. This is accompanied by the tensioning and stressing of a cascade spring arrangement 29 including a pair of leaf springs 31 and 32. Leaf spring 31 has a first end fastened between the free ends of the first levers 6*a*, and a second end provided with a follower pin 30. The other leaf spring 32 is defined in the side plate body portions 6*b* by slots 37 that extend generally parallel with the associate outer peripheries of the body portions. At shown in FIGS. 6 and 7, at one end, the slot includes an end portion 38 that is enlarged and rounded to reduce mechanical stress. At its other end, the slot defines a free end portion of spring 32 that carries the pivot pin 15, together with a tab portion having a surface H that is engaged by the pin 30 carried by the extremity of the second spring 31.

Thus, the toggle joint kinematics 14 is brought into the tensioned condition by activating the lever 19, as a result of which the die member 8 executes a clockwise rotary movement. The radial support of the die member 8 is secured by the contact in the areas L between the crimping stamps 5 and the sliding piece plate 8. The support points of the crimping stamps 5 therefore also serve at the same time as support for the die member 8. The grooves 11 in the elements 10 makes a radial longitudinal compensation for the crimping stamps 5 possible that is produced by the rotary movement of the crimping stamps 5. The advantage of this solution resides in a flat contact and therefore in a reduced local surface pressure between sliding piece 10 and crimping stamps 5 over the entire activation path.

Figure 6:
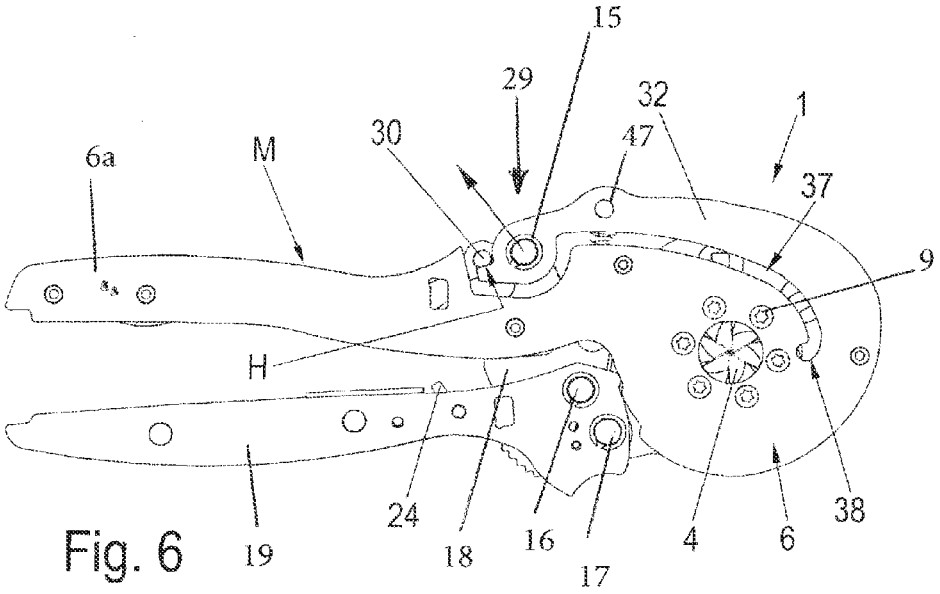
FIG. 6 is a right elevation view of the apparatus of FIG. 1 when the cascade spring means is in the unstressed condition.
Figure 7:
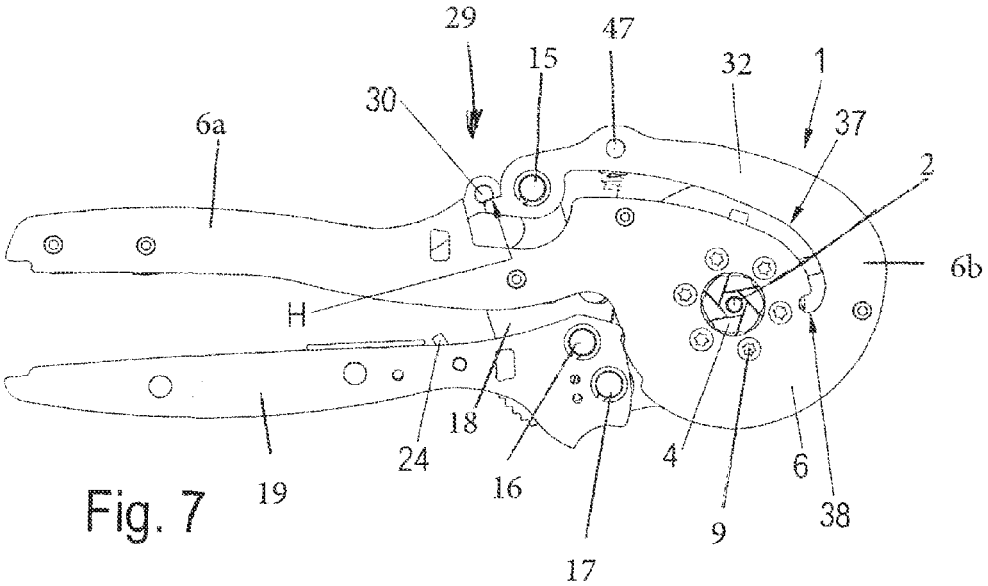
FIG. 7 is a corresponding view when the cascade spring means is in the fully-stressed caged crimping condition.

Referring now to FIGS. 6 and 7, in order to be able to process the different cross-sections of wire end ferrules and conductors in the crimping die 4, a force path compensation device in the form of a cascade spring 29 is integrated into the base sheet 6 that makes possible a deviation of the rear toggle joint point of rotation in the direction of the arrow. When a ferrule 2 is to be crimped onto the bare end of a conductor, the two components are inserted into the die opening 7 with the levers in the open position (FIGS. 3 and 4), and the levers are pivoted together toward the closed position of FIG. 7. Pivot pin 15 is displaced upwardly by the thrust link as shown by the arrow in FIG. 6, thereby expanding the associated end of slot 37 as shown in FIG. 7, as well as moving follower pin 30 upwardly to tension leaf spring 31. Consequently, both leaf springs 31 and 32 are tensioned to a caged stressed condition, corresponding with the transverse dimension of the ferrule. During the final pivoting of the levers toward their fully closed condition, the stress of the cascade spring means is applied to the crimping die elements, thereby to assist in the final stage of the crimping operation. The stressing of the leaf springs 31 and 32 is limited by means of the stop arrangement provided by the cooperation between the stop pin 34 on lever 31 and the edges J of the window formed in the thrust link 18, as shown in FIGS. 5, 8 and 10.

Thus, the second spring 31 of the cascade spring arrangement 29 is driven by the cylinder pin 30 over the surface H on the base sheet 6. The spring 31 is located on the same plane as the thrust strut 18 that lies between the two base sheets 6 and has a thickness, like that of the thrust strut 18, that is substantially identical to the intermediate space between the base sheets 6. An increased force and an enlarged path for the force path compensation device to be created for the crimping tool is made available by the advantageous spring action of the cooperation of the springs 31, 32.

The cascade spring 29 receives the required remaining stroke of the crimping die 4 as elastic deformation work when the crimping die 4 has already been moved on block during the crimping of a wire end ferrule 2; however a path must still be traversed in order that the pawl 24 frees the opening of the crimping die 4. The crimping tool 1 therefore automatically adjusts to the ferrule cross section and the conductor cross section. The crimping tool 1 can be automatically be opened and closed until it engages the pawl 24. The integration of the spring 32 as a leaf spring connected in parallel into the base sheets 6 makes possible a compact construction of the crimping tool 1 with simultaneous, precise coordination with the required force path compensation. Less construction space with the same performance is required in comparison to other constructions. In order to prevent a lifting off of the surface H from the cylinder pin 30 and the base sheet 6 under load, the base sheet 6 has a cross section with great rigidity in the area M. Therefore, a deformation of the base sheet 6 under load is prevented and a constant, reproducible force path compensation is realized.

Figure 10:
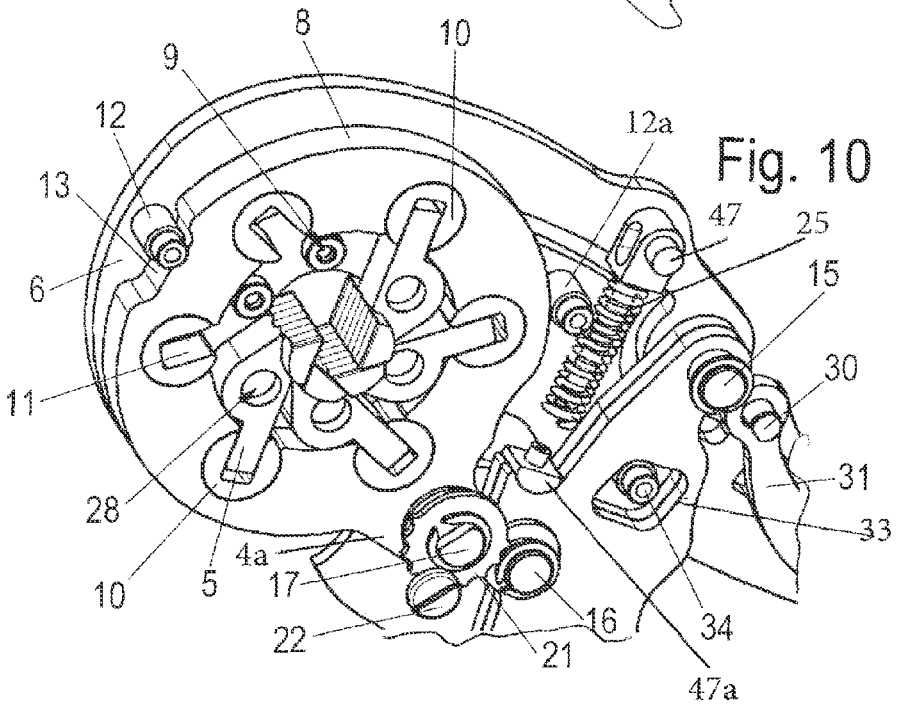
FIG. 10 is a detailed view of the die means of FIG. 9.
Figure 11:
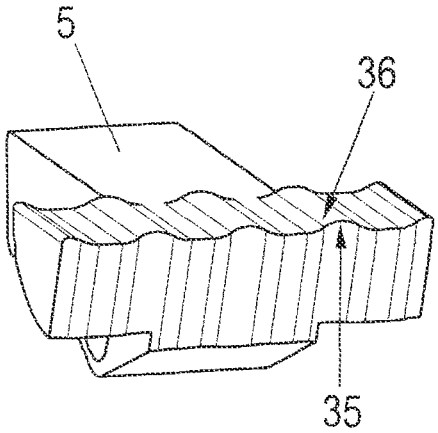
FIG. 11 is a perspective view of one of the die elements of the apparatus of FIG. 1.
Figure 12:
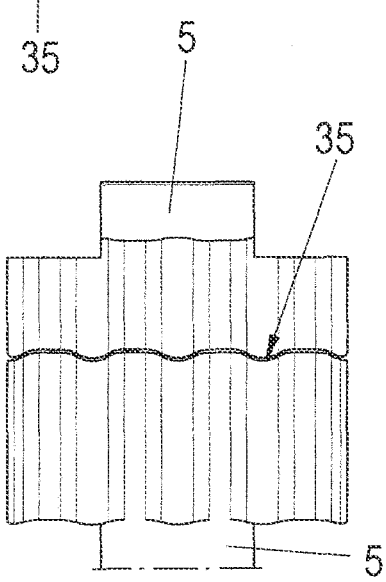
FIG. 12 is a top plan view of two engaged die elements.

FIGS. 10, 11 and 12 show in detail the crimping elements 5 that form the crimping die 4. For an optimized pressing and for reducing the sensitivity to fracture of the crimped wire end ferrule 2 the crimping elements 5 have a corrugated contour 35 on the active stamping surface 36. A sharp-edged construction such as, e.g., triangular or quadratic contours on the active stamping surface 36 would leave a sharp-edged impression on the finished, crimped wire end ferrule 2 in comparison that would increase the sensitivity to fracture of the crimped wire end ferrule 2. In order to prevent a clamping of wire end ferrules 2 with rather small cross sections between the crimping elements 5, the contour 35 of the active stamping surface 36 is constructed in such a manner that adjacent crimping stamps 5 engage in each other in a contour-congruent manner (see FIG. 12). The contour 35 of the active stamping surface 36 of the crimping elements 5 is designed in such a manner that, given an appropriate positioning of the wire end ferrule 2 into the crimping die 4 on the end of the wire end ferrule 2, an introductory slope G is produced that simplifies the introduction of the wire end ferrule 2 into a clamping system (see FIG. 13).

Figure 14:
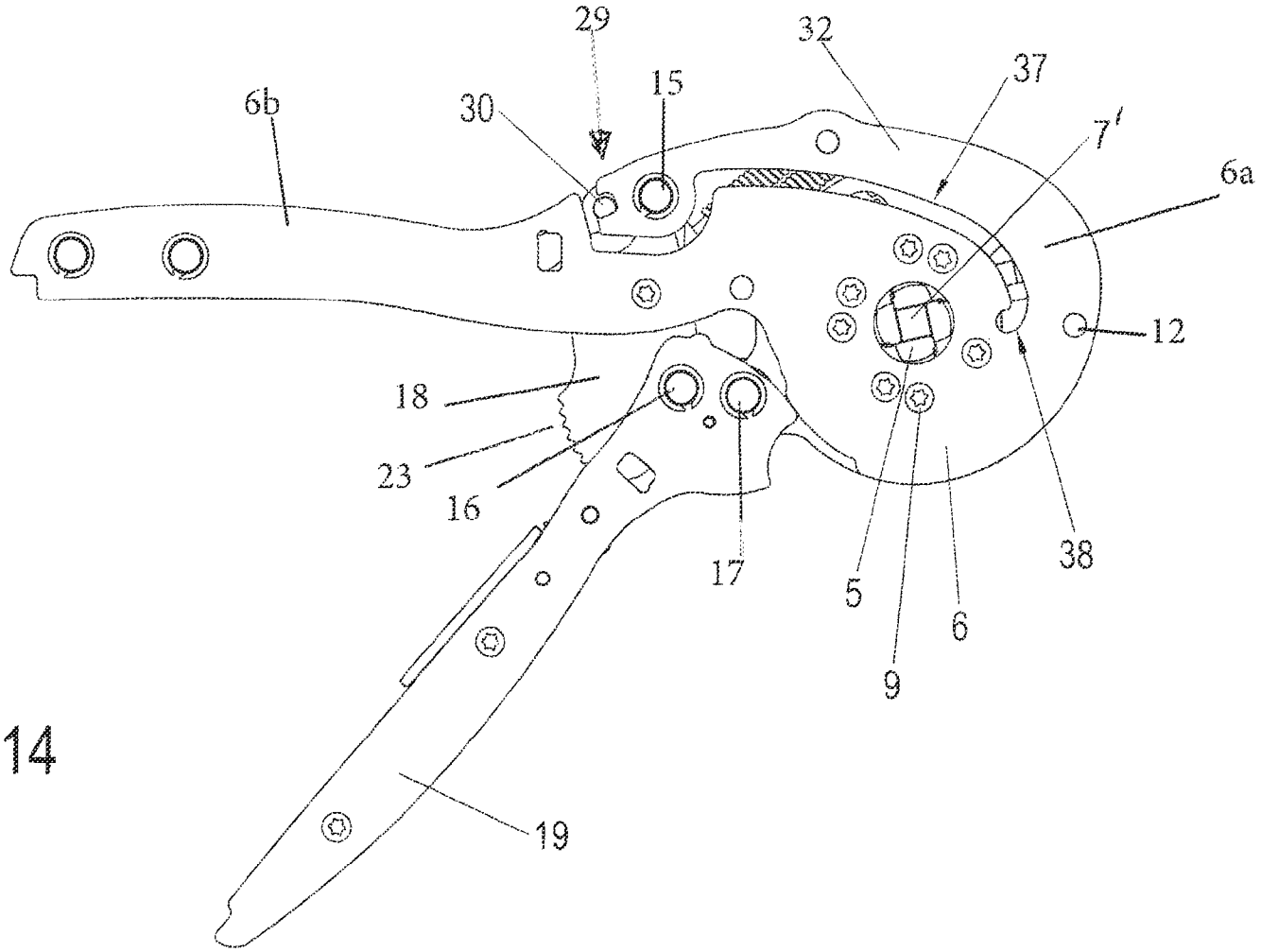
FIG. 14 is a right hand elevation view of a crimping tool embodiment of the present invention having four crimping die elements when in the open condition.
Figure 15:
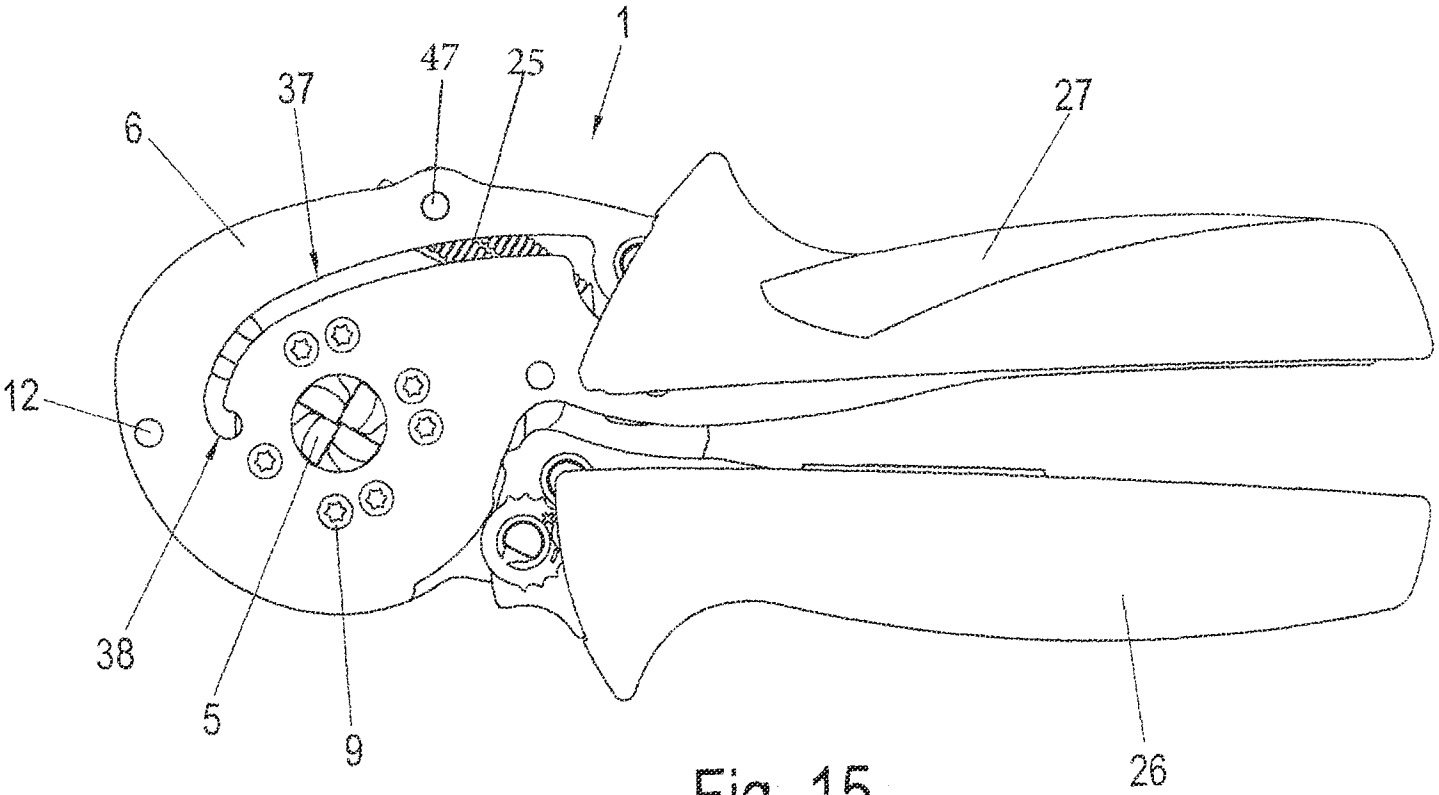
FIG. 15 is a corresponding view of the apparatus of FIG. 14 when in the closed condition.

FIG. 14 shows a crimping tool 1 with an open crimping die 4 that comprises four crimping stamps 5 and therefore forms a square crimp on a wire end ferrule. FIG. 15 shows a crimping tool 1 with a closed crimping die 4 moved on block that comprises four crimping stamps 5.

Since the method of operation of a crimping tool 1 for the crimping die 4 that has 4 crimping elements is analogous to that of a crimping tool 1 with a crimping die 4 that has six crimping elements 5, in order to avoid repetitions a detailed description of this variant will not be given.

While in accordance with the provisions of the Patent Statutes the preferred forms and embodiments of the invention have been illustrated and described, it will be apparent to those skilled in the art that changes may be made without deviating from the invention described above.

What is claimed is:

1. A scissors-type crimping tool for crimping a female electrical contact onto the bare end of an electrical conductor, comprising:

(a) a frame including at least one general planar base member (6) having a body portion containing an opening, and a first portion extending from said body portion to define a first lever (6*a*) having a free end;

(b) crimping die means for crimping a female metal ferrule (2) onto the bare end of a conductor (3), said crimping die means including an annular crimping die member (4) rotatably connected with said base member body portion in collinear alignment with said base member opening, said crimping die member being rotatable between angularly displaced open and crimping positions relative to said base member;

(c) operating means for angularly displacing said crimping die member between said open and said crimping position, said operating means including:

(1) a second lever (19) having first and second ends;

(2) a toggle link arrangement (14) connecting said second lever first end with said base member body portion to afford generally pivotal displacement of said second lever between open and closed crimping positions relative to said first lever;

(3) a first lever pivot pin (17) connecting said second lever with said die member such that said die member is angularly displaced between said open and closed crimping positions as said second lever is pivoted between said open and closed crimping positions, respectively, said toggle link arrangement having a first condition during the initial pivotal movement of said second lever from said open position toward an intermediate position between said open and closed crimping positions, and an over-center second condition during the subsequent travel of said second lever from said intermediate position toward said closed crimping position; and (d) cascade spring means (29) operable by said toggle arrangement from a non-stressed condition to a stressed caged condition when said second lever is pivoted from said open position toward said intermediate position, and to a released condition when said second lever is pivoted from said intermediate position toward said closed crimping position, thereby to provide a force path compensating means for processing different cross-sections of wire end ferrules and conductors in the crimping die, and for applying the force of the released energy of the stressed cascade spring means to said crimping die member during the final stage of the crimping operation.

2. A crimping tool as defined in claim 1, wherein said toggle arrangement includes a thrust link (18) having a first end pivotally connected with said base member body portion by a second pivot pin (15), and a second end pivotally connected with said second lever first end by a third pivot pin (16) arranged generally between said first and second pivot pins.

3. A crimping tool as defined in claim 2, wherein said base member is formed from a resilient metal sheet; and further wherein said cascade spring means includes a first leaf spring (32) defined by a slot (37) contained in said member body portion such that said leaf spring has a free end, said second pivot pin extending into a pivot opening contained in said first leaf spring free end, whereby said first leaf spring is stressed by said thrust link during the initial movement of said second lever from said open position toward said intermediate position.

4. A crimping tool as defined in claim 3, wherein said cascade spring means further includes a second leaf spring (31) having a first end rigidly connected with said first lever free end, said second leaf spring having a second end that terminates adjacent said first leaf spring free end for operation thereby to effect a stressed condition in said second leaf spring when said first spring is operated by said toggle link to said stressed condition.

5. A crimping tool as defined in claim 4, and further including biasing spring means (25) biasing said second lever toward said open position; and ratchet and pawl means (23, 24) preventing return pivotal displacement of said second lever during the movement thereof from said open position toward said closed position.

6. A crimping tool as defined in claim 4, wherein said crimping die means further includes a plurality of crimping members (5) that are pivotally connected with said base member body portion in circumferentially spaced relation about the opening contained therein, said die elements having adjacent first ends provided with tips that define a die opening (7, 7'), said die elements being simultaneously operable by said annular die member for displacement between open positions for receiving a bare conductor end with a ferrule supported thereon, and crimping positions in which the ferrule is crimped onto the bare conductor end.

7. A crimping tool as defined in claim 6, and further including adjustment means (21, 22) for adjusting the initial angular position of said die member relative to said base member body portion, thereby to adjust the size of the die opening (7, 7') when said die elements are in their initial open position.

8. A crimping tool as defined in claim 7, wherein said crimping elements are pivotally connected intermediate their ends by crimping element pivot pins (9) with said base member body portion, said crimping elements having second ends that are guided in slots (11) contained in rotatable cylinders (10) mounted in the inner circumferential surface of said annular die member.

9. A crimping tool as defined in claim 7, and further including pin and slot means (12, 13) for limiting the extent of angular displacement of said die operating member relative to said base member body portion.

10. A crimping tool as defined in claim 4, and further including stop means (33, 34) limiting the extent of displacement of said first and second lever free ends in the stressed direction relative to said base member body portion.

11. A crimping tool as defined in claim 6, wherein said crimping elements have corrugated guide surfaces (35) in interlocked sliding engagement.

12. A crimping tool as defined in claim 1, wherein said frame includes a pair of said base members mounted together in parallel spaced relation on opposite sides of said annular die member.

* * * * *